US005348667A

United States Patent [19]

Bacon et al.

[11] Patent Number: 5,348,667

[45] Date of Patent: Sep. 20, 1994

[54] PROCESS FOR PRODUCING DRYER-ADDED FABRIC SOFTENER SHEETS CONTAINING CYCLODEXTRIN COMPLEXES

[75] Inventors: Dennis R. Bacon, Milford; Thomas A. Borcher, Sr., Cincinnati; Alessandro Corona, III, Maineville; Clyde D. Palmer, Cincinnati; Toan Trinh, Maineville, all of Ohio

[73] Assignee: The Procter & Gamble Company, Cincinnati, Ohio

[21] Appl. No.: 134,163

[22] Filed: Oct. 8, 1993

[51] Int. Cl.[5] ..... D06M 15/11

[52] U.S. Cl. ..... 252/8.6; 252/8.7; 252/8.75; 252/8.8; 252/8.9

[58] Field of Search ..... 252/8.6, 8.75, 8.8, 252/8.9, 8.7

[56] References Cited

U.S. PATENT DOCUMENTS

| | | | |
|---|---|---|---|
| 3,442,692 | 5/1969 | Gaiser | 117/120 |
| 4,073,996 | 2/1978 | Bedenk et al. | 428/274 |
| 4,267,166 | 5/1981 | Yajima | 424/48 |
| 4,296,138 | 10/1981 | Boden | 426/534 |
| 4,348,416 | 9/1982 | Boden | 426/3 |
| 4,678,598 | 7/1987 | Ogino et al. | 252/174.17 |
| 4,992,198 | 2/1991 | Nebashi et al. | 252/174.11 |
| 5,094,761 | 3/1992 | Trinh et al. | 252/8.6 |
| 5,139,687 | 8/1992 | Borgher, Sr. et al. | 252/8.6 |
| 5,232,612 | 8/1993 | Trinh et al. | 252/8.6 |
| 5,246,611 | 9/1993 | Trinh et al. | 252/8.6 |

FOREIGN PATENT DOCUMENTS

| | | |
|---|---|---|
| 0041328 | 12/1981 | European Pat. Off. . |
| 3020269 | 1/1981 | Fed. Rep. of Germany . |
| 63-165498 | 7/1988 | Japan . |

*Primary Examiner*—Mark L. Bell
*Assistant Examiner*—C. M. Bonner
*Attorney, Agent, or Firm*—Robert B. Aylor

[57] ABSTRACT

Cyclodextrin complexes are prepared utilizing processes in which the cyclodextrin/active complex is prepared under concentrated reaction conditions in which there is no more than about 40% solvent, e.g., water, with mechanical working, to provide a complex ultimate particle size of less than about 12 microns and the resulting complex reaction mixture is incorporated, preferably without further operation, into at least one fabric conditioning material, preferably cationic fabric conditioning active, preferably in liquid (molten) form, preferably at a temperature between about 60 and about 95° C., and mechanically worked to reduce complex aggregate particle size below about 200 microns. The resulting complex/fabric conditioning material mixture is used to prepare, e.g., dryer-added fabric softener article, e.g., sheet. The mixture of complex and fabric softener material preferably contains a small amount of an anionic surfactant to help avoid deposition of, e.g., unreacted cyclodextrin onto the equipment used to prepare the fabric conditioning composition and/or article (sheet).

23 Claims, No Drawings

PROCESS FOR PRODUCING DRYER-ADDED FABRIC SOFTENER SHEETS CONTAINING CYCLODEXTRIN COMPLEXES

TECHNICAL FIELD

The present invention relates to processes for producing products such as dryer-added fabric softener sheets containing cyclodextrin/active complexes of, e.g., perfumes.

BACKGROUND OF THE INVENTION

The use of cyclodextrin as a complexing agent for materials is well documented, including the disclosures in, e.g., U.S. Pat. Nos.: 5,102,564 and 5,234,610, Gardlik, Trinh, Banks, and Benvegnu, said patents being incorporated by reference. Despite the voluminous art relating to the preparation and use of cyclodextrin complexes in various products, there has been a continuing, need for improved processes for preparing products such as dryer-added fabric sheets containing, e.g., cyclodextrin/perfume complexes.

Processes for preparing dryer-added fabric softener articles containing cyclodextrin complexes of, e.g., perfume have been disclosed as set forth in detail in the patents incorporated by reference herein. However, the commercial realities of preparing successful consumer products require simple processes. It is not sufficient that the complex can be prepared and incorporated. For commercial success, the cost must be commensurate with the benefit obtained. The previous lack of commercial use and/or success for complexes in consumer products is undoubtedly related to the excessive expense of producing such complexes and incorporating them into products.

SUMMARY OF THE INVENTION

The cyclodextrin/active complexes herein are prepared fast and effectively utilizing processes in which the cyclodextrin/active complex is prepared under concentrated reaction conditions, with high mechanical energy input to provide, for example, complex ultimate particles that are smaller than about 12 microns, as described more fully hereinafter. The process preferably utilizes no more than about 40%, more preferably from about 20% to about 40%, and even more preferably about 30%, solvent, e.g., water, and the resulting complex reaction mixture, including said solvent, is incorporated into relatively water-insoluble fabric conditioning material which is preferably in liquid, e.g., molten form, e.g., nonionic, cationic, or mixtures of nonionic and cationic fabric conditioning materials, especially fabric conditioning material comprising cationic fabric conditioning actives, preferably with the addition of a small amount of water-soluble, e.g., detergent, surfactant, i.e., less than about 1%, preferably less than about 0.8%, more preferably from about 0.2% to about 0.6% of anionic surfactant, preferably $C_{6-20}$ alkyl sulfate or, more preferably, alkylbenzene sulfonate, or any similar anionic surfactant containing a similar alkyl hydrophobic group, or equivalent hydrophobic group, to help avoid deposition of, e.g., unreacted cyclodextrin onto the equipment used to prepare the fabric conditioning composition and/or article as described hereinafter.

The complex reaction mixture normally contains particles, actual or apparent, that are larger than about 200 microns. Therefore, when the reaction mixture is mixed with the fabric conditioning material, it is subjected to mechanical working to reduce the particle size to less than about 200 microns, preferably to from about 50 to about 100 microns. The larger size particles give the final fabric conditioning composition an undesirable "grainy" feel, whereas particles of less than 100 microns are indistinguishable from the fabric conditioning composition itself by normal consumers. The ultimate particle size, as opposed to the actual particle size, can be less than about 12, preferably less than about 10, more preferably less than about 8, and even more preferably less than about 5, typically between about 0.001 and about 10, preferably between about 0.05 and about 5 microns (micrometers).

Processes for forming complexes of the actives with cyclodextrins and/or their derivatives are described in the patents incorporated hereinbefore and hereinafter. These processes typically involve some separation or separate size reduction steps. The present invention combines steps in the preparation of the products, thus making the processes commercially useful. In addition, the use of the surfactant, e.g., anionic surfactant, provides an unobvious advantage in avoiding deposition of, e.g., uncomplexed cyclodextrin, a problem that was not previously identified.

DESCRIPTION OF THE INVENTION

Cyclodextrin/active complexes are readily prepared, for example, in small ultimate particle size form, i.e., less than 12 microns, by mechanically working the active ingredient with the cyclodextrin in the presence of solvent, preferably no more than about 40%, more preferably from about 20% to about 40%, and even more preferably about 30%, compatible solvent, typically water. Although the ultimate particle size can be quite small, the actual/apparent particles, e.g., aggregates or agglomerates, are quite large. The resulting complex reaction mixture is then mixed with one, or more of the ingredients of a fabric conditioning composition, preferably in liquid, i.e., molten form, preferably at a temperature of from about 57° to about 95° C., more preferably at a temperature of from about 60° to about 90° C., and subjected to mechanical working to reduce the agglomerate particles of the reaction mixture, which are typically from about 200 to about one inch in size, to less than about 200 microns, preferably less than about 75 microns, in size. The fabric conditioning ingredient (material), can be any one, or combination, of the materials normally used for fabric conditioning especially the anionic and/or nonionic compounds disclosed in U.S. Pat. No. 5,139,687, Borcher et al., said patent being incorporated herein by reference. Said materials are described also hereinafter.

1. CYCLODEXTRINS

As used herein, the term "cyclodextrin" (CD) includes any of the known cyclodextrins such as unsubstituted cyclodextrins containing from six to twelve glucose units, especially, alpha-, beta-, gamma-cyclodextrins, and mixtures thereof, and/or their derivatives, and/or mixtures thereof, that are capable of forming inclusion complexes with perfume ingredients. Beta-cyclodextrin is the most preferred cyclodextrin and the one whose complex benefits most from the small particle size. Alpha-, beta-, and gamma-cyclodextrins can be obtained from, among others, American Maize-Products Company (Amaizo), Hammond, Ind.; Roquette Corporation, Gurnee, Ill.; and Chinoin Pharmaceutical and Chemical Works, Ltd., Budapest, Hungary. There are many derivatives of cyclodextrins that are known. Representative derivatives are those disclosed in U.S. Pat. Nos: 3,426,011, Parmerter et al., issued Feb. 4, 1969; 3,453,257, 3,453,258, 3,453,259, and 3,453,260, all in the names of Parmerter et al., and all issued Jul. 1, 1969; 3,459,731, Gramera et al., issued Aug. 5, 1969; 3,553,191, Parmerter et al., issued Jan. 5, 1971; 3,565,887, Parmerter et al., issued Feb. 23, 1971; 4,535,152, Szejtli et al., issued Aug. 13, 1985; 4,616,008, Hirai et al., issued Oct. 7, 1986; 4,638,058, Brandt et al., issued Jan. 20, 1987; 4,746,734, Tsuchiyama et al., issued May 24, 1988; and 4,678,598, Ogino et al., issued Jul. 7, 1987, all of said patents being incorporated herein by reference. Examples of cyclodextrin derivatives suitable for use herein are methyl-β-CD, hydroxyethyl-β-CD, and hydroxypropyl-β-CD of different degrees of substitution (DS), available from, among others, Aldrich Chemical Company, Milwaukee, Wis.; Wacker Chemicals (USA), New Canaan, Conn.; and Chinoin Pharmaceutical Works, Budapest, Hungary. Water-soluble derivatives are also highly desirable.

The individual cyclodextrins can also be linked together, e.g., using multifunctional agents to form oligomers, polymers, etc. Examples of such materials are available commercially from Amaizo and from Aldrich Chemical Company (β-CD/epichlorohydrin copolymers).

It is also desirable to use mixtures of cyclodextrins to provide a mixture of complexes. Such mixtures, e.g., can provide preferred odor profiles by encapsulating a wider range of active ingredients, e.g., perfume. Mixtures of cyclodextrins can conveniently be obtained by using intermediate products from known processes for the preparation of cyclodextrins including those processes described in U.S. Pat. Nos.: 3,425,910, Armbruster et al., issued Feb. 4, 1969; 3,812,011, Okada et al., issued May 21, 1974; 4,317,881, Yagi et al., issued Mar. 2, 1982; 4,418,144, Okada et al., issued Nov. 29, 1983; and 4,738,923, Ammeraal, issued Apr. 19, 1988, all of said patents being incorporated herein by reference. Preferably at least a major portion of the cyclodextrins are alpha-cyclodextrin, beta-cyclodextrin, and/or gamma-cyclodextrin, more preferably beta-cyclodextrin. Some cyclodextrin mixtures are commercially available from, e.g., Ensuiko Sugar Refining Company, Yokohama, Japan.

2. THE ACTIVES

Many different active materials can be complexed with cyclodextrins as set out in the patents incorporated herein-before and hereinafter by reference. Perfumes are a highly desirable active material that can usually benefit from protection and that can be complexed, especially when the perfume is relatively hydrophobic. In general, active materials that form complexes with cyclodextrin and are released by the action of water are useful in the practice of this invention.

Perfumes

Fabric softening products typically contain some perfume to provide some fragrance to provide an olfactory aesthetic benefit and/or to serve as a signal that the product is effective.

The use of cyclodextrin/perfume complexes in such products is detailed in U.S. Pat. Nos. 5,102,564 and 5,234,610, Gardlik et al., incorporated hereinbefore by reference.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective.

The classification of perfumes by substantivity and by volatility is discussed in detail in said U.S. Pat. Nos. 5,102,564 and 5,234,610 said disclosures being incorporated herein by reference.

Cyclodextrin inclusion complexes (perfume/cyclodextrin, or perfume/CD, complexes), as described hereinafter, of the high boiling, the moderately volatile, and the low boiling perfume ingredients are stable (a) throughout the mixing of the complexes with the remainder of the compositions, e.g., the molten fabric softener mixes, including when the fabric softener mixes contain some clay, and the coating of the resulting fabric softening compositions onto flexible substrates to form fabric conditioning sheets, (b) during the application of the composition to the substrate, e.g., during the drying of the wet fabrics in tumble dryers, and (c) during use, e.g., when the cosmetic is on the skin or during the wear of the dry fabrics. The content of the perfume in the complex is typically from about 5% to about 15%, more normally from about 7% to about 10%.

3. COMPLEX FORMATION

The complexes are formed in a concentrated process in which the cyclodextrin and the active are present with from about 20% to about 40%, preferably about 30%, of suitable solvent, typically water and mechanically working, e.g., kneading the ingredients together to create a complex, e.g., with the small ultimate particle size described hereinbefore. The kneading (or extrusion) method is particularly desirable because it can utilize less solvent thus minimizing, or eliminating, the need to separate the excess solvent. The kneading process produces a very fine dispersion of perfume and high viscosity of the concentrated reaction mixture helps keep the perfume dispersed. For typical fabric conditioning compositions, the presence of solvents such as water causes undesirable phase changes that result in sticky, unprocessable products. Suitable processes are disclosed in the patents incorporated hereinbefore by reference. Additional disclosures of complex formation can be found in Atwood, J. L., J. E. D. Davies & D. D. MacNichol, (Ed.): *Inclusion Compounds, Vol. III*, Academic Press (1984), especially Chapter 11, and Atwood, J. L. and J. E. D. Davies (Ed.): *Proceedings of the Second International Symposium of Cyclodextrins* Tokyo, Japan, (July, 1984).

In general, active/cyclodextrin complexes have a molar ratio of active compound to cyclodextrin of 1:1. However, the molar ratio can be either higher or lower, depending on the size of the active compound and the identity of the cyclodextrin compound. The molar ratio can be determined easily by forming a saturated solution of the cyclodextrin and adding the active to form the complex. In general the complex will precipitate readily. If not, the complex can usually be precipitated by the addition of electrolyte, change of pH, cooling, etc. The complex can then be analyzed to determine the ratio of active to cyclodextrin.

For commercial processes, it is highly desirable to have at least about 70% of the active, e.g., perfume, complexed. Although the percent of active complexed can be improved by using more cyclodextrin, it is normally not desirable to use more cyclodextrin, since it is believed that the uncomplexed cyclodextrin is responsible for the deposits that interfere with the processing of the fabric conditioning compositions after the complex is incorporated. It is desirable to allow additional time for the complex to form after the mechanical working is finished.

As stated hereinbefore, the actual complexes are determined by the size of the cavity in the cyclodextrin and the size of the active molecule. Although the normal complex is one molecule of active in one molecule of cyclodextrin, complexes can be formed between one molecule of active and two molecules of cyclodextrin when the active molecule is large and contains two portions that can fit in the cyclodextrin. Highly desirable complexes can be formed using mixtures of cyclodextrins since actives like perfumes are normally mixtures of materials that vary widely in size. It is usually desirable that at least a majority of the material be alpha-, beta-, and/or gamma-cyclodextrin, more preferably beta-cyclodextrin.

Processes for the production of cyclodextrins and complexes are described in U.S. Pat. Nos.: 3,812,011, Okada, Tsuyama, and Tsuyama, issued May 21, 1974; 4,317,881, Yagi, Kouno and Inui, issued Mar. 2, 1982; 4,418,144, Okada, Matsuzawa, Uezima, Nakakuki, and Horikoshi, issued Nov. 29, 1983; 4,378,923, Ammeraal, issued Apr. 19, 1988, all of said patents being incorporated herein by reference.

4. COMPLEX PARTICLE SIZES

The actual particles of complex in the reaction mixture, and in the initial premix between the complex reaction mixture and at least a portion of the fabric conditioner composition, are quite large (≧200 microns), as mentioned hereinbefore. However, particle sizes above about 200 microns can hurt performance by limiting distribution of the complex of the fabric, causing processing problems, and causing "feel" problems, especially in substrate article as described hereinafter. It is essential to break up these large particles and prevent them from reforming. The actual particle size should be less than 200 microns, preferably less than 100, microns. Less than 10 microns provides less performance, 10–50 microns more performance, and 50–100 microns is preferred. Mechanically working in fabric conditioning material combines operations and inhibits particle reformation.

The ultimate particle sizes of the complexes herein can be selected to improve the release, and especially the speed-of-release, of the active. E.g., the ultimate particles can have a particle size of less than about 12 microns, preferably less than about 10 microns, more preferably less than about 8 microns, and even more preferably less than about 5 microns, are desirable for providing a quick release of the active when the complexes are wetted.

This small ultimate particle size range is typically between about 0.001 and 10 microns, preferably between about 0.05 and 5 microns. It is typically preferable that at least an effective amount of the active be in complexes having the said particle sizes. E.g., it is preferable that at least about 75%, preferably at least about 80% and more preferably at least about 90% of the complex that is present have the said ultimate particle sizes, and even better if essentially all of the complex has the said particle sizes.

Such small particles can be conveniently prepared by the process herein. Cyclodextrin complexes with small particle sizes are obtained as the desired smaller particles of about 10 microns and less by using, e.g., the process.

As used herein, unless otherwise stated, the particle size refers to the largest dimension of the particle and to the actual particles, not the ultimate (or primary) particles. The size of the primary particles can be directly determined with optical or scanning electron microscopes. The microscopic slides used to determine particle sizes must be carefully prepared so that each contains a representative sample of the bulk cyclodextrin complexes. The particles sizes can also be measured by any of the other well-known methods, e.g., wet sieving, sedimentation, light scattering, etc. A convenient instrument that can be used to determine the particle size distribution of the dry complex powder directly (without having to make a liquid suspension or dispersion) is the Malvern Particle and Droplet Sizer, Model 2600C, sold by Malvern Instruments, Inc., Southborough, Mass. Some caution should be observed when measuring ultimate particles in that some of the dry particles may remain agglomerated. As stated before, the presence of agglomerates can be further determined by microscopic analysis. Some other suitable methods for particle size analysis are described in the article "Selecting a particle size analyzer: Factors to consider," by Michael Pohl, published in Powder and Bulk Engineering, Volume 4 (1990), pp. 26–29. It is recognized that any very small ultimate particles readily aggregate to form agglomerates (the actual particles) that are then broken down to the desired size by mechanical action after mixing with the fabric conditioning material. Accordingly, ultimate particles should be measured after the agglomerates are completely broken apart, e.g., by agitation, sonication, and/or dehydration. The method, of course, should be selected to accommodate the particle size and maintain the integrity of the ultimate complex particles, with iterative measurements being made if the original method selected proves to be inappropriate.

5. THE WATER-SOLUBLE SURFACTANT

Water-soluble surfactants useful herein comprise the usual anionic, nonionic and amphoteric surfactants. Anionic surfactants are preferred.

(1) Anionic, e.g., Sulfated or Sulfonated Surfactant

Typical synthetic, e.g., anionic sulfated and/or sulfonated detergent surfactants are the alkyl- and alkylethoxylate-(polyethoxylate) sulfates, paraffin sulfonates, alkyl benzene sulfonates, olefin sulfonates, alpha-sulfonates of fatty acids and of fatty acid esters, and the like, which are well known from the detergency art. In general, such surfactants contain an alkyl group in the $C_9$–$C_{22}$, preferably $C_{10}$–$C_{18}$, more preferably $C_{12}$–$C_{16}$, range. The anionic surfactants can be used in the form of their sodium, potassium or alkanolammonium, e.g., triethanolammonium salts. $C_9$–$C_{15}$ alkyl benzene sulfonates are especially preferred in the compositions of the present type.

A detailed listing of suitable anionic detergent surfactants, of the above types can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company.

The anionic detergent cosurfactant component is typically present at a level of from about 0.1% to about 1%, more preferably from about 0.2% to about 0.6%.

(2) The Nonionic Surfactant

The nonionic surfactants herein are the conventional ones that typically have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such nonionic surfactants comprise a hydrophobic group which is a hydrocarbyl group, preferably derived from fatty alcohols, which contain an alkyl group in the $C_{6-22}$, preferably $C_{8-18}$, more preferably $C_{8-10}$, range and generally contain from about 2.5 to about 12, preferably from about 4 to about 10, more preferably from about 5 to about 8, ethylene oxide groups, to give an HLB of from about 8 to about 16, preferably from about 10 to about 14.

Other nonionic surfactants which are useful herein include block copolymers of propylene glycol and ethylene glycol having the formula:

$$R(EO)_n(PO)_m(EO)_nR$$

wherein EO is ethylene oxide, PO is propylene oxide, each n and m are selected to give a surfactant having a total molecular weight of from about 2,000 to about 8,000, preferably from about 3,000 to about 10,000, more preferably from about 4,000 to about 8,000, and each R being selected from hydrogen (preferred) and hydrocarbon groups, preferably $C_{1-4}$ hydrocarbon groups. These surfactants have an EO content of from about 20% to about 80%, preferably from about 20% to about 40%. Such surfactants typically have an HLB of from about 4 to about 30, preferably from about 7 to about 24, more preferably from about 7 to about 18.

A detailed listing of nonionic surfactants in general is found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company.

(3) Amphoteric, e.q., Zwitterionic Surfactants

Such surfactants contain both cationic and anionic hydrophilic groups on the same molecule at some pH. Zwitterionic surfactants have both groups over a relatively wide range. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used.

A generic formula for some preferred zwitterionic detergent surfactants is:

$$R-N(+)(R^2)(R^3)R^4X(-)$$

wherein R is a hydrophobic group; $R^2$ and $R^3$ are each hydrogen, $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms: and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc.

These surfactants are also used at low levels to inhibit deposition.

6. THE COMPOSITIONS

The present invention primarily relates to processes for making improved solid consumer fabric conditioning compositions containing the complex, which are preferably (A) incorporated into articles of manufacture in which the compositions containing the complexes are, e.g., on a substrate, or, are, less preferably, (B) in the form of particles (including, where appropriate, agglomerates, pellets, and tablets of said particles).

A. Substrate Articles

In preferred embodiments, the present invention encompasses processes for preparing articles of manufacture. These articles are adapted for use to provide unique perfume benefits and to condition (soften) fabrics in an automatic laundry dryer. Such articles are disclosed in U.S. Pat. Nos.: 3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28, 1989; 4,103,047, Zaki et al., issued Jul. 25, 1978; 3,736,668, Dillarstone, issued Jun. 5, 1973; 3,701,202, Compa et al., issued Oct. 31, 1972; 3,634,947, Furgal, issued Jan. 18, 1972; 3,633,538, Hoeflin, issued Jan. 1, 1972; and 3,435,537, Rumsey, issued Apr. 1, 1969; and 4,000,340, Murphy et al., issued Dec. 28, 1976, all of said patents being incorporated herein by reference.

Typical articles of manufacture of this type include articles comprising:

I. a fabric conditioning composition comprising:
   i. from about 30% to about 99% of fabric conditioning, preferably softening, agent; and
   ii. an effective amount, preferably from about 0.5% to about 60%, of perfume/cyclodextrin complex, as described hereinafter;

II. a dispensing means which provides for release of an effective amount of said composition to fabrics in an automatic laundry dryer at automatic laundry dryer operating temperatures, e.g., from about 35° C. to 115° C.

When the dispensing means is a flexible substrate, e.g., in sheet configuration, the fabric conditioning composition is releasably affixed on the substrate to provide a weight ratio of conditioning composition to dry substrate ranging from about 10:1 to about 0.5:1, preferably from about 5:1 to about 1:1. The invention comprises the method of manufacturing such an article of manufacture utilizing said complex ii. by premixing the complex ii. with at least a portion of the fabric softening agent i. and mechanically working the mixture to reduce the size of the complex agglomerates to less than about 100 microns. The softener helps protect the complex from the water.

The term "fabric conditioning (softening) agent" as used herein includes cationic and nonionic fabric softeners used alone and also in combination with each other. A preferred fabric softening agent of the present invention is a mixture of cationic and nonionic fabric softeners.

(1) Fabric Conditioning (Softening) Agents

Examples of fabric softening agents that are especially useful in the substrate articles are the compositions described in U.S. Pat. Nos. 4,103,047, Zaki et al., issued Jul. 25, 1978; 4,237,155, Kardouche, issued Dec. 2, 1980; 3,686,025, Morton, issued Aug. 22, 1972; 3,849,435, Diery et al., issued Nov. 19, 1974; and U.S. Pat. No. 4,073,996, Bedenk, issued Feb. 14, 1978; said patents are hereby incorporated herein by reference.

Another preferred type of fabric softener is described in detail in U.S. Pat. No. 4,661,269, Toan Trinh, Errol H. Wahl, Donald M. Swartley and Ronald L. Hemingway, issued Apr. 28, 1987, said patent being incorporated herein by reference.

As stated hereinbefore, fabric conditioning agents can be nonionic, cationic, or mixtures thereof. These fabric conditioning agents and the compositions herein can be used for other purposes than fabric treating. E.g., the agents can be used to treat other substrates and/or for other end uses depending upon, e.g., the actives in the complex.

Examples of nonionic fabric softeners are fatty alcohols, fatty acids, fatty acid esters of, e.g., hydroxy, including polyhydroxy alcohols, including glycerine, sugars, etc., and/or fatty alcohol esters of carboxylic acids. More specific examples include sorbitan esters, $C_{12}$–$C_{26}$ fatty alcohols, and fatty amines described herein.

More biodegradable fabric softener compounds can be desirable. Biodegradability can be increased, e.g., by incorporating easily destroyed linkages into hydrophobic groups. Such linkages include ester linkages, amide linkages, and linkages containing unsaturation and/or hydroxy groups. Examples of such fabric softeners can be found in U.S. Pat. Nos.: 3,408,361, Mannheimer, issued Oct. 29, 1968; 4,709,045, Kubo et al., issued Nov. 24, 1987; 4,233,451, Pracht et al., issued Nov. 11, 1980; 4,127,489, Pracht et al., issued Nov. 28, 1979; 3,689,424, Berg et al., issued Sep. 5, 1972; 4,128,485, Baumann et al., issued Dec. 5, 1978; 4,161,604, Elster et al., issued Jul. 17, 1979; 4,189,593, Wechsler et al., issued Feb. 19, 1980; and 4,339,391, Hoffman et al., issued Jul. 13, 1982, said patents being incorporated herein by reference.

A preferred article of the present invention includes a fabric treatment composition which comprises from about 0.5% to about 60%, preferably from about 1% to about 50%, more preferably from about 5% to about 40%, of perfume/cyclodextrin complex and from about 30% to about 99%, preferably from about 40% to about 90%, of fabric conditioning (softening) agent. Preferably, said fabric softening agent is selected from cationic and nonionic fabric softeners and mixtures thereof. Preferably, said fabric softening agent comprises a mixture of about 5% to about 80% of a cationic fabric softener and about 10% to about 85% of a nonionic fabric softener by weight of said fabric treatment composition. The selection of the components is such that the resulting fabric treatment composition has a melting point above about 38° C. and is flowable at dryer operating temperatures.

(2) Dispensing Means

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 10 g, most preferably from about 1 g to about 5 g.

One such article comprises a sponge material releasably enclosing enough fabric treatment composition to effectively impart fabric soil release and softness benefits during several cycles of clothes. This multi-use article can be made by filling a hollow sponge with about 20 grams of the fabric treatment composition.

Other devices and articles suitable for dispensing the fabric treatment composition into automatic dryers include those described in U.S. Pat. Nos.: 4,103,047, Zaki et al., issued Jul. 25, 1978; 3,736,668, Dillarstone, issued Jun. 5, 1973; 3,701,202, Compa et al., issued Oct. 31, 1972; 3,634,947, Furgal, issued Jan. 18, 1972; 3,633,538, Hoeflin, issued Jan. 11, 1972; and 3,435,537, Rumsey, issued Apr. 1, 1969. All of these patents are incorporated herein by reference.

Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

(3) Usage

The substrate embodiment of this invention can be used for imparting the above-described fabric treatment composition to fabric to provide perfume effects and/or softening and/or antistatic effects to fabric in an automatic laundry dryer comprises: commingling pieces of damp fabric by tumbling said fabric under heat in an automatic clothes dryer with an effective amount of the fabric treatment composition, at least the continuous phase of said composition having a melting point greater than about 35° C and said composition being mobilized, e.g., flowable, at dryer operating temperature, said composition comprising from about 0.5% to about 60%, preferably from about 1% to about 50%, more preferably from about 5% to about 40%, of perfume/cyclodextrin complex and from about 30% to about 99%, preferably from about 40% to about 90%, of fabric softening agent selected from the above-defined cationic and nonionic fabric softeners and mixtures thereof.

B. Detergent-Compatible Compositions

Another type of fabric conditioning composition useful herein is detergent-compatible and includes compositions containing softening particles such as those known in the art, including specifically: U.S. Pat. No. 3,936,537, Baskerville Jr., issued Feb. 3, 1976, and U.S. Pat. No. 4,095,946, Jones, issued Jun. 20, 1978, both of which teach the use of intimate mixtures of organic dispersion inhibitors (e.g., stearyl alcohol and fatty sorbitan esters) with solid fabric softener to improve the survival of the softener in the presence of detergent in the washer so that the softener can act on the fabrics when it is mobilized in the dryer, and U.S. Pat. No. 4,234,627, Schilling, issued Nov. 18, 1980, which teaches microencapsulation of fabric softener (The microcapsules survive the wash and adhere to the fabric surface. They are then ruptured by subsequent tumbling of the fabric in the dryer, thereby releasing softener to the fabrics.)

The particles in such detergent-compatible fabric conditioning compositions comprise at least about 10% of fabric softening agent, preferably cationic fabric softening agent. For detergent compatibility, the particles often have a coating as described hereinafter, a sufficiently large particle size (e.g., a minimum dimension greater than about 5,000 microns), or some combination of coating and particle size depending upon the level of protection desired.

C. Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

A preferred additional ingredient in the compositions herein is free active, e.g., perfume, other than the active which is present as the active/cyclodextrin complex, which is also very useful for imparting the active, e.g., odor benefits. Such uncomplexed active is preferably present at a level of from about 0.10% to about 10% by weight of the total.

For example, perfume delivery both via free perfume and cyclodextrin/perfume complexes, in solid, dryer-activated, fabric conditioning compositions in laundry fabric dryers is desirable in two ways. Product malodors can be covered by the addition of free perfume to the softener composition to obtain a more preferred product odor, and complexed perfume can be transferred onto fabric with the softener actives in the laundry fabric dryer to provide better in-wear fabric odor. (Preferably, such uncomplexed perfume comprises at least about 1%, more preferably at least about 10% by weight of said uncomplexed perfume, of substantive perfume materials.)

Products of this invention preferably only contain enough free perfume to deliver both an acceptably low product perfume odor and an acceptable initial fabric perfume odor. Perfume incorporated into the product in the form of perfume/CD complex as part of a substrate article or in the form of solid fabric softener particles containing perfume/CD complex (in the case of detergent compatible products), will be released when the fabric is used in situations where renewed perfume odor is really and appropriately needed, e.g., when some moisture is present, such as when using wash cloths and towels in a bathroom, or when there is perspiration on clothes during and after a high level of physical activity.

The products can also contain only the perfume/CD complex, without any noticeable amount of free perfume. In this case, the products function initially almost as unscented products.

If a product contains both free and complexed perfume, the escaped perfume from the complex contributes to the overall perfume odor intensity, giving rise to a longer lasting perfume odor impression.

Thus, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the complexes, since they are applied at the very end of a fabric treatment regimen when the fabric is clean and when there are almost no additional treatments that can affect the perfume.

All percentages, ratios, and parts herein, in the Specification, Examples, and claims, are by weight unless otherwise stated.

The following are nonlimiting examples of the instant articles and methods.

Continuous Cyclodextrin/Perfume Complex Production

Cyclodextrin/Perfume complex is prepared using about 66.5% beta-cyclodextrin (12% water), about 22% additional water, and about 11.5% perfume. This represents a stoichiometric excess of perfume to minimize uncomplexed cyclodextrin and typically results in about 70% of the perfume being complexed. When higher levels of uncomplexed cyclodextrin are acceptable, more cyclodextrin can be used and will result in higher percentages of perfume complexation. For example, the reaction can use about 68% of said beta-cyclodextrin, about 24% water, and about 8% perfume to provide about 90% perfume complexation. Particle sizes are measured by microscopy or ASTM: D1210-79.

EXAMPLE I (a) About 66.5% of beta-cyclodextrin (12% water), about 22% water, and about 11.5% perfume are added at a total rate of about 500 grams per minute to a Teledyne Readco Continuous Processor (2 inch diameter barrel by 16 inches long). The mixer speed is 400 RPM and the mixer is run at a variety of paddle configurations and exit die plate configurations, including no die plates, all of which provide specific mechanical energy input to the mixture that is greater than 1 horsepower per pound per minute.

(b) The ingredients from (a) are added at a rate of about 25 pounds (approximately 11.3 kilograms) per minute to an APV Baker MPF-80 twin-screw extruder (80 mm barrel by 25 inches) with no exit die. The mixer speed is about 400 RPM and the paddle configuration is selected to provide specific mechanical energy input to the mixture that is greater than 1 horsepower per pound per minute.

EXAMPLES OF PREPARING FABRIC CONDITIONING SUBSTRATE ARTICLES

The above reaction mixtures are used in preparing substrate articles. The reaction mixture is added to a portion of the final fabric conditioning composition, this premix comprising about 33.8% of the perfume complex, about 32.6% of sorbitan monostearate, about 32.6% dimethylditallowylammonium methyl sulfate (DTDMAMS), and about 1% sodium $C_{13}$ linear-alkylbenzene sulfonate (NaLAS). The complex is added after an approximately 10 minute time to allow perfume complexation to be more complete. The complex is mixed with the other ingredients in molten form and processed at from about 60°–90° C. to reduce the particle size of the complex agglomerates to less than about 200 microns. (Temperatures that are lower make the mechanical working much less efficient with this formula.) This premix allows the complex agglomerate particle size to be reduced without having to provide mechanical work to the entire formula. Blends with 40% complex are also prepared. The mixtures are processed in a Likwifier Model LOR in a continuous system.

The complex/fabric-conditioning-ingredient premix is pumped to a Fryma MZ Colloid Mill where the complex aggregate particle size is reduced to about 200–400 microns and then to two Fryma MS-50 ball mills where the complex aggregate particle size is further reduced to less than about 100 microns. This particle size reduction makes the eventual fabric conditioning composition indistinguishable to the ordinary consumer, from a tactile viewpoint, from the same composition without the complex. The linear alkyl benzene sulfonate allows the composition to be processed without excessive deposition on the equipment.

The complex is also cooled and mixed with the frozen fabric conditioning ingredients to provide a mix that is mechanically worked in the mixer of 1(a) to reduce the complex aggregate particle size. Ratios of 90:10, 45:55 (best), and 10:90 complex:softener ingredients are processed. Although the desired complex particle size is achieved, this process involves two additional steps of cooling and then reheating. Therefore, the first, hot, process is preferred.

Preparation of Fabric Conditioning Sheets

The premix in molten form is mixed with the remainder of the fabric conditioning composition to provide about 56.65% premix and about 41.74% of the remaining ingredients comprising: about 33.05% of stearyldimethylamine salt of stearic fatty acid and free stearic acid, the ratio of salt to acid being about 35:65; about 2.39% sorbitan monostearate; about 2.39% DTMAMS; about 1.61% free perfume; and about 3.91% calcium Bentonite clay. These remaining ingredients are blended, or dispersed, in a Likwifier and pumped to an impregnation head after mixing with the premix and final blending in a Ross high shear mixer. The impregnation head distributes the total fabric conditioning composition as a final coating mix across the width of a substrate.

The flexible substrate, comprised of 70% 3-denier, 1-9/16 inch long (approximately 4 cm) rayon fibers and 30% polyvinyl acetate binder, is impregnated by coating one side of a continuous length of the substrate and contacting it with a rotating cylindrical member which serves to press the liquefied mixture into the interstices of the substrate. (A similar process practiced with a spun bonded polyester substrate gives substantially equivalent results.) The amount of fabric conditioning mixture applied is controlled by the flow rate of the mixture and/or the line speed of the substrate. The substrate is passed over several chilled tension rolls which help solidify the conditioning mixture. The substrate sheet is 9 inches wide (approximately 23 cm) and is perforated in lines at 9 inch intervals (approximately 23 cm) to provide detachable sheets. Each sheet is cut with a set of knives to provide three evenly spaced parallel slits averaging about 3.5 inches in length (approximately 8 cm). In this Example, the application rate is adjusted to apply about 2.3 g of coating mixture per sheet. Each sheet contains about 1.72 g of softener, about 0.9 g of clay, and about 0.44 g of Complex, about 0.013 g NaLAS, and about 0.037 g free perfume.

Fabric Treatment

A laundry load is washed in a washer with the unscented TIDE® detergent. The wet laundry load is transferred and dried in an electric tumble dryer with a fabric conditioning sheet of Example 1. The resulting dry fabric has only very low perfume odor, but when the fabric is re-wetted a noticeably stronger perfume odor is obtained.

EXAMPLES OF DETERGENT-COMPATIBLE PARTICLES

EXAMPLE 2

| Softener Core Particles | |
|---|---|
| Components | Example 9 |
| Ditallowdimethylammonium methylsulfate (DTDMAMS) | 38.51 |
| Cetyl Alcohol | 19.17 |
| Sorbitan Monostearate | 19.17 |
| Complex | 20.15 |
| Calcium Bentonite Clay | 3.00 |
| Total | 100.00 |

The fabric conditioning composition of Example I is converted to particles by pouring it into trays and cooling it overnight at about 4° C. Particles are formed by cooling and then milling in a Fitzmill, Model DA506 (The Fitzpatrick Company, Elmhurst, Ill. 60126) at 4740 rpm's through a 4 mesh screen. The particles are then sized through 11 on 26 (U.S. Standard screens, (0.6–1.7 mm) particle size).

The particles are then coated with a 10% solution of Ethocel in methanol. The coating is applied in an 18 inch Wurster Coater (Coating Place, Inc., P.O. Box 248, Verona, Wis. 53593). The ethyl cellulose used is Ethocel Std. 10 (Dow Chemical Co., Midland, Mich. 48640), which has an Ubbelohde viscosity of 9.0–11.0, measured at 25° C. as a 5% solution in 80% toluene/20% ethanol.

The following conditions are used to apply the cellulose-based coating:

| | |
|---|---|
| Fluidizing Air | 15.8 Cu.M/min. at 40.5° C. |
| Atomizing Air Volume | 0.37 Cu.M/min. |
| Atomizing Air Rate | 5624 g/sq.cm. |
| Inlet Air Temperature | 38° C.–43° C. |
| Outlet Air Temperature | 30° C.–32° C. |
| Pump Rate | 0.2 Kg/min. |
| Nozzle Size | CPI-18-A74* |
| Partition Gap | 216 mm × 267 mm |

-continued

| | |
|---|---|
| Partition Size | 19 mm |
| Run Time | 55 min. |

*Available from Coating Place, Inc.

The amount of coating applied to the particles is about 3% by weight of the total coated particle weight. When the coating is completed, the softener particles are resized through 11 on 26 mesh U.S. Standard screens and are then ready for use "as is" or for blending into detergent granules.

EXAMPLE 3

A detergent/softener composition is prepared by mixing about 5.2 parts of the coated softener particles of Example 2 with 94.8 parts of the following granular detergent composition:

| Ingredient | Parts |
|---|---|
| Na $C_{13}$ linear alkyl benzene sulfonate | 9.5 |
| Na $C_{14}$-$C_{15}$ fatty alcohol sulfate | 9.5 |
| Ethoxylated $C_{12}$-$C_{13}$ fatty alcohol | 1.9 |
| $Na_2SO_4$ | 11.1 |
| Sodium silicate (1.6r) | 6.5 |
| Polyethylene glycol (M.W. 8,000) | 0.7 |
| Polyacrylic acid (M.W. 1,200) | 0.9 |
| Sodium tripolyphosphate | 31.0 |
| Sodium pyrophosphate | 7.5 |
| $Na_2CO_3$ | 10.2 |
| Optical brightener | 0.2 |
| Protease enzyme (Alcalase) | 0.7 |
| Moisture | 9.3 |
| Miscellaneous | 1.0 |
| Total | 100.0 |

EXAMPLE 4

Alternate granular detergent/softener compositions are prepared by mixing about 5.2 parts of the coated softener of Example 2 with about 94.8 parts of the following granular detergent composition:

| Ingredient | Parts |
|---|---|
| Na $C_{13}$ linear alkyl benzene sulfonate | 11.5 |
| Na $C_{14}$-$C_{15}$ fatty alcohol sulfate | 11.5 |
| Ethoxylated $C_{12}$-$C_{13}$ fatty alcohol | 1.9 |
| $Na_2SO_4$ | 14.0 |
| Sodium silicate (1.6r) | 2.3 |
| Polyethylene glycol (M.W. 8,000) | 1.8 |
| Polyacrylic acid (M.W. 1,200) | 3.5 |
| Hydrated Zeolite A (~2 microns) | 28.9 |
| $Na_2CO_3$ | 17.0 |
| Optical brightener | 0.2 |
| Protease enzyme (Alcalase) | 0.6 |
| Moisture and Miscellaneous | 7.0 |
| Total | 100.2 |

What is claimed is:

1. Solid dryer-adder fabric conditioning composition comprising an effective amount of active/cyclodextrin inclusion complex reaction mixture having an actual particle size of less than about 200 microns, said composition being prepared by a process in which said complex is prepared by a concentrated process with mechanical working and the resulting reaction mix is added directly to at least a portion of said fabric conditioning composition with mechanical working to reduce particle size of the complex to less than about 200 microns.

2. The composition of claim 1 wherein said cyclodextrin is selected from the group consisting of: unsubstituted cyclodextrins containing from about six to about twelve glucose units; derivatives of said unsubstituted cyclodextrins; and mixtures thereof, and wherein said cyclodextrin is capable of forming inclusion complexes with active ingredients.

3. The composition of claim 2 wherein at least a major portion of said cyclodextrin is selected from the group consisting of alpha-cyclodextrin; beta-cyclodextrin; gamma-cyclodextrin; and mixtures thereof.

4. The composition of claim 3 wherein at least a major portion of said cyclodextrin is beta-cyclodextrin.

5. The composition of claim 4 wherein said active is a perfume and at least a major portion of said perfume is selected from the group consisting of: highly volatile perfume; moderately volatile perfume; and mixtures thereof.

6. The composition of claim 5 wherein at least a major portion of said perfume is highly volatile perfume.

7. The composition of claim 1 wherein at least a major portion of said active is selected from the group consisting of: highly volatile perfume; moderately volatile perfume; and mixtures thereof.

8. The composition of claim 7 wherein said cyclodextrin is selected from the group consisting of: unsubstituted cyclodextrins containing from about six to about twelve glucose units; derivatives of said unsubstituted cyclodextrins; and mixtures thereof, and wherein said cyclodextrin is capable of forming inclusion complexes with perfume ingredients.

9. The composition of claim 7 wherein at least a major portion of said cyclodextrin comprises cyclodextrin selected from the group consisting of alpha-cyclodextrin; beta-cyclodextrin; gamma-cyclodextrin; and mixtures thereof.

10. The composition of claim 1 wherein said process is continuous and the cyclodextrin and the active are complexed in the presence of less than about 40% solvent.

11. The composition of claim 10 wherein said cyclodextrin complex has a majority of particles ranging in size between about 10 microns and about 100 microns.

12. The composition of claim 11 wherein said cyclodextrin is selected from the group consisting of: unsubstituted cyclodextrins containing from about six to about twelve glucose units; derivatives of said unsubstituted cyclodextrins; and mixtures thereof, and wherein said cyclodextrin is capable of forming inclusion complexes with active ingredients.

13. The composition of claim 12 wherein said cyclodextrin is selected from the group consisting of: alpha-cyclodextrin; beta-cyclodextrin; gamma-cyclodextrin; and mixtures thereof.

14. The composition of claim 13 wherein at least a major portion of said cyclodextrin is beta-cyclodextrin.

15. The process of making a dryer-added fabric conditioning composition comprising preparing cyclodextrin/active complex reaction mixture under concentrated reaction conditions with no more than about 40% solvent with high mechanical energy input to provide complex ultimate particles that are smaller than about 12 microns and incorporating the resulting complex reaction mixture into at least one fabric conditioning material and mechanically working to reduce aggregate particle size of the complex to less than about 200 microns.

16. The process of claim 15 wherein the said solvent level is from about 20% to about 40% and the complex aggregate particle size is less than about 100 microns.

17. The process of claim 16 wherein said fabric conditioning material is in liquid form.

18. The process of claim 17 wherein said fabric conditioning material is selected from the group consisting of cationic fabric softener, nonionic fabric softener, and mixtures thereof, said fabric conditioning material is in molten form, and the temperature is between about 60° and about 95° C.

19. The process of claim 18 wherein said complex agglomerate particle size is less than about 75 microns.

20. The process of claim 18 wherein the mixture of said complex reaction mixture and said molten fabric conditioning material additionally comprises a water-soluble surfactant in an amount of less than about 1% to reduce deposition from the mixture onto equipment used to process the mixture.

21. The process of claim 20 in which said surfactant is an anionic surfactant.

22. The process of claim 21 in which said surfactant is an alkyl benzene sulfonate.

23. In a process of preparing an article of manufacture which is a dryer-added fabric conditioning product comprising:

I. a fabric conditioning composition comprising:
   i. from about 30% to about 99% of fabric conditioning agent; and
   ii. an effective amount of perfume/cyclodextrin complex; and II. a dispensing means which provides for release of an effective amount of said composition to fabrics in an automatic laundry dryer at automatic laundry dryer operating temperatures, wherein the improvement comprises making the fabric conditioning composition by the process of claim 20.

* * * * *